United States Patent [19]

Kivi

[11] 4,024,481

[45] May 17, 1977

[54] FREQUENCY DRIFT COMPENSATION DUE TO TEMPERATURE VARIATIONS IN DIELECTRIC LOADED CAVITY FILTERS

[75] Inventor: Aare Kivi, Massapequa, N.Y.

[73] Assignee: International Telephone and Telegraph Corporation, Nutley, N.J.

[22] Filed: Jan. 7, 1976

[21] Appl. No.: 647,020

[52] U.S. Cl. ..... 333/82 BT; 333/83 T

[51] Int. Cl.[2] ..... H01P 1/30; H01P 7/04

[58] Field of Search ..... 333/82 B, 82 BT, 83 T, 333/73 W

[56] References Cited

UNITED STATES PATENTS

| | | | |
|---|---|---|---|
| 2,103,515 | 12/1937 | Conklin et al. | 333/82 BT |
| 2,489,433 | 11/1949 | Rambo | 333/82 B |

*Primary Examiner*—Paul L. Gensler
*Attorney, Agent, or Firm*—John T. O'Halloran, Alfred C. Hill

[57] ABSTRACT

The arrangement includes a TEM cavity having a shunt inductive rod having one end connected to one wall of the cavity and a capacitive gap between the other end of the rod and a member of the cavity with the cavity and gap being filled with a solid dielectric material. The thermal coefficient of expansion of the metal of the cavity, the metal of the rod and the dielectric are all selected so that in cooperation with a selected physical dimension of the gap and a selected length of the rod the rate of change of the inductive and capacitive reactance of the cavity are equalized during a temperature variation so that their difference remains zero at the operating frequency of the cavity.

13 Claims, 4 Drawing Figures

FREQUENCY DRIFT COMPENSATION DUE TO TEMPERATURE VARIATIONS IN DIELECTRIC LOADED CAVITY FILTERS

BACKGROUND OF THE INVENTION

This invention relates to cavity filters and more particularly to an arrangement to compensate for frequency drift due to temperature variations in such cavities.

Temperature dependent frequency drifts from resonant frequency in TEM coaxial cavity filters are usually compensated by constructing the entire cavity, or at least critical areas of the cavity, with low thermal expansion coefficient material. INVAR steel has been successfully used in numerous applications in various filter designs since it has one of the lowest thermal expansion coefficients in the metal family. However, in lower frequency bands (below 2000 megahertz) this practice becomes expensive since the TEM coaxial cavity and resonant structures are machined at greater cost.

Temperature dependent frequency drifts become more severe where the TEM coaxial cavity design requires solid dielectric loading. As an example a dielectric loaded TEM coaxial cavity is employed to avoid multipacting in a space vacuum environment. Such an arrangement is disclosed in the copending application of A. Kivi and L. Feit, Ser. No. 626,161, filed Oct. 28, 1975, whose disclosure is incorporated herein by reference. The solid dielectric, such as REXOLITE No. 1422, has a much higher thermal coefficient of expansion, and when used in a metal cavity its dimensions and tolerances must be compatible with the lower thermal coefficient of expansion of the metal of the cavity and the metal of the coaxial resonator or inductance rod. Therefore, a cavity constructed from a lower thermal coefficient of expansion material would further complicate design efforts.

SUMMARY OF THE INVENTION

An object of the present invention is to provide a temperature dependent frequency drift compensation arrangement by controlling the equivalent cavity inductance and capacitance of the cavity.

A feature of the present invention is the provision of an arrangement to compensate for frequency drift due to temperature variation in dielectric loaded cavity filters having a predetermined operating frequency comprising: a metal TEM coaxial cavity, the metal of the cavity having a selected thermal coefficient of expansion; a metal shunt inductive rod having a selected length with one end connected to one wall of the TEM cavity and a capacitive gap between the other end of the rod and a member of the TEM cavity, the metal of the rod having a selected thermal coefficient of expansion and the gap having at least one selected physical dimension; and a solid dielectric material having a selected thermal coefficient of expansion disposed to fill the TEM cavity and the gap; the thermal coefficient of expansion of the metal of the TEM cavity, the metal of the rod and the dielectric material, the one physical dimension of the gap and the length of the rod all cooperating to equalize the rate of change of the equivalent inductive and capacitive reactance of the TEM cavity so that the difference between the rate of change of the equivalent inductive reactance of the TEM cavity and the rate of change of the equivalent capacitive reactance of the TEM cavity remains zero during a temperature variation at the predetermined operating frequency.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENTS

Figure 1:
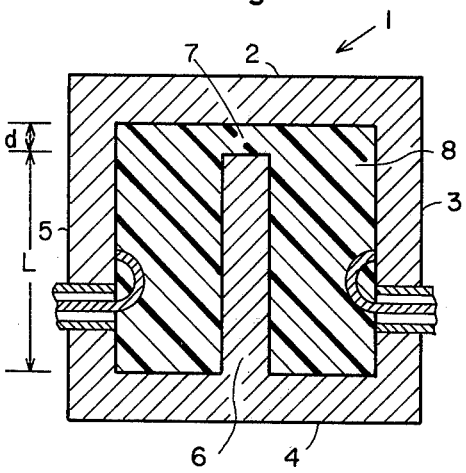
FIG. 1 is a cross-sectional view of a TEM coaxial re-entrant cavity which is temperature dependent frequency drift compensated in accordance with the principles of the present invention.

Referring to FIG. 1 there is illustrated therein a TEM coaxial re-entrant cavity 1 having metal walls 2 – 5 and a shunt inductive resonator rod 6 having one end connected to wall 4 and the other end spaced from wall 2 to define a capacitive gap 7. Cavity 1 and gap 7 are filled with a suitable dielectric material 8.

Figure 2:
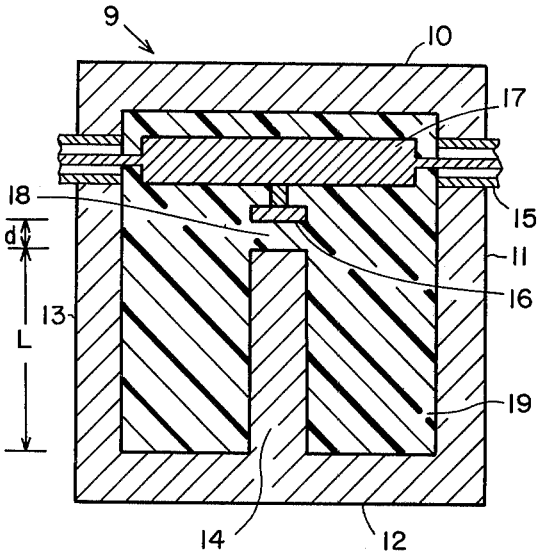
FIG. 2 is a cross-sectional view of a TEM coaxial shunt cavity which is temperature dependent frequency drift compensated in accordance with the principles of the present invention.

Referring to FIG. 2 there is illustrated therein a TEM coaxial shunt cavity 9 having metal walls 10 – 13, a shunt inductive resonator rod 14, a coaxial feed through transmission line 15 and a capacitive disc 16 capacitively coupled to center conductor 17 of transmission line 15. One end of rod 14 is connected to wall 12 and the other end spaced from disc 16 to define a capacitive gap 18. Cavity 9 and gap 18 are filled with a suitable dielectric material 19.

In accordance with the principles of the present invention temperature dependent frequency drift compensation is provided by compensating for the total reactance slope variation of cavities 1 and 9. The incremental change of the equivalent cavity inductance is compensated by the incremental change of the equivalent cavity capacitance during temperature variations. The equivalent cavity inductance is proportional to the length L of rods 6 and 14 while the equivalent cavity capacitance is inversely proportional to the width *d* of gaps 7 and 18. The equivalent inductive reactance is given by the following formula:

$$X_L = Z_b \tan\left(\frac{2\pi\sqrt{e}\,L}{\lambda}\right)$$

The equivalent capacitive reactance omitting fringing capacitance is given by the following formula:

$$X_C = \left[\frac{0.225\,e\,A}{d}\right]^{-1} X\,[2\pi f_o]^{-1},$$

where $Z_b$ = characteristic impedance of cavity 1 or 9, $e$ = dielectric constant of dielectric material 8 or 19, $f_o$ = resonant frequency of cavity 1 or 9, $\lambda$ = wavelength of the resonant frequency and A = cross-sectional area of capacitive gap 7 or 18. The total reactance slope variation is balanced or cancelled by letting the rate of change of inductive reactance variation equal the rate of change of the capacitive reactance variation. Mathematically this is expressed as follows:

$$\frac{d}{dw}\left[Z_b \tan \phi\right] = \frac{d}{dw}\left[\frac{1}{w_o c}\right]$$

or $$\frac{d}{d\phi}\ \frac{d\phi}{dw}\left[Z_b \tan \phi\right] = \frac{d}{dc}\ \frac{dc}{dw}\left[\frac{1}{w_o c}\right]$$

and finally $\sec^2 \phi\ {}^d\phi = -\tan \phi(dc/c)$,
where $d$ = width of gap 7 or 18, $dw$ = differential of $2\pi f_o$, $\phi$ = electrical length of rod in cavity 1 or 9, $$\phi = \frac{2\pi L}{\lambda}\sqrt{e},\ w = 2\pi f_o,$$

c = capacitance, $d\phi$ = incremental change of phase due to variation of rod length L and $dc$ = incremental change of capacitance due to variation of gap width $d$. It should be noted that inductive variation is proportional to the incremental change in length dL or incremental change in phase $d\phi$.

Thus, according to the principles of the present invention the TEM coaxial cavity temperature dependent frequency drift is compensated for by equalizing the rate of change of inductive and capacitive reactance so that their difference remains zero at a given reference frequency $f_o$.

Figure 3:
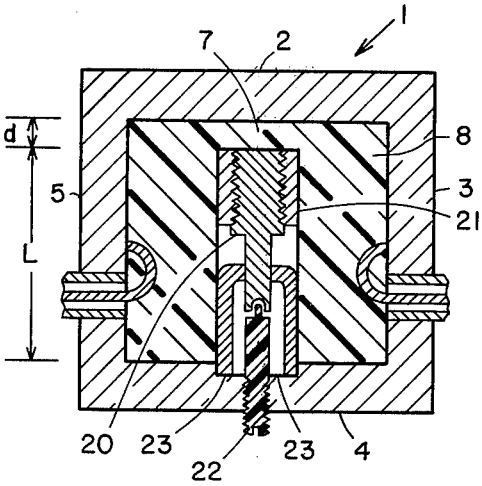
FIG. 3 is a cross-sectional view of a second embodiment of a TEM coaxial re-entrant cavity which is temperature dependent frequency compensated in accordance with the principles of the present invention.

Referring to FIG. 3 there is illustrated therein a modification of the TEM coaxial re-entrant cavity of FIG. 1. The modification is directed to the construction of rod 6 of FIG. 1. In FIG. 3 the shunt inductive resonator rod 20 is threaded to engage a threaded sleeve 21 to enable adjusting the width $d$ of gap 7 by means of dielectric element 22 threaded into wall 4. The end of rod 20 remote from gap 7 is connected to wall 4 by means of spring fingers 23.

Figure 4:
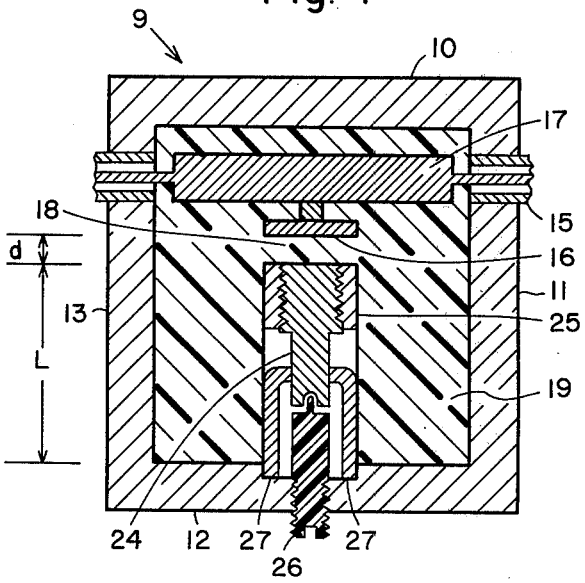
FIG. 4 is a cross-sectional view of a second embodiment of a TEM coaxial shunt cavity which is temperature dependent frequency compensated in accordance with the principles of the present invention.

Referring to FIG. 4 there is illustrated therein a modification of the TEM coaxial shunt cavity of FIG. 2. The modification is directed to the construction of rod 14 of FIG. 2. In FIG. 4 the shunt inductive resonator rod 24 is threaded to engage a threaded sleeve 25 to enable adjusting the width $d$ of gap 18 by means of dielectric element 26 threaded into wall 12. The end of rod 24 remote from gap 18 is connected to wall 12 by means of spring finger 27.

In accordance with the principles of the present invention the TEM cavity capacitance reactance is made up of the cross-sectional area of the tuning rod 20 or 24 and sleeve 21 or 25 which is approximately equivalent to the cross-sectional area of wall 2 or capacitive disc 16 and the width $d$ of gap 7 or 18. The rate of change of the capacitive reactance is controlled by (1) thickness $d$ of dielectric material 8 or 19 in gap 7 or 18, (2) cross-sectional area of rod 20 or 24 and sleeve 21 or 25, (3) linear thermal coefficient of expansion of dielectric material 8 or 19 and (4) linear thermal coefficient of expansion of sleeve 21 or 25 and rod 20 or 24.

The cavity wall 2 or transmission line 15, rod 20 or 24, sleeve 21 or 25 and dielectric material 8 or 19 make up one integral assembly. During thermal variation the incremental change in $d$ is dependent upon $\Delta d = dk$ (product of d and thermal coefficient of expansion of dielectric material 8 or 19).

The capacitive change becomes independent of the linear thermal expansion of the cavity walls 2 – 5 or 10 – 13, since rod 20 or 24 is de-coupled from cavity walls 2 – 5 or 10 – 13 by the electrical contact made between rod 20 or 24 and wall 4 or 12 through spring fingers 23 or 27. This permits the spring fingers 23 or 27 to travel with the cavity walls 2 – 5 or 10 – 13 without changing the position of rod 20 or 24.

The rate of incremental change of the equivalent cavity inductance or length of rod 20 or 24 depends upon (1) the cavity wall dimensions (not shown), (2) the length L, and (3) the thermal coefficient of expansion of rod 20 or 24, spring fingers 23 or 27 and cavity wall material.

While I have described above the principles of my invention in connection with specific apparatus it is to be clearly understood that this description is made only by way of example and not as a limitation to the scope of my invention as set forth in the objects thereof and in the accompanying claims.

I claim:

1. An arrangement to compensate for frequency drift due to temperature variation in dielectric loaded cavity filters having a predetermined operating frequency comprising:

a metal TEM coaxial cavity, said metal of said cavity having a selected thermal coefficient of expansion;

a metal shunt inductive rod having a selected length with one end connected to one wall of said TEM cavity and a capacitive gap between the other end of said rod and a member of said TEM cavity, said metal of said rod having a selected thermal coefficient of expansion and said gap having at least one selected physical dimension; and a solid dielectric material having a selected thermal coefficient of expansion disposed to fill said TEM cavity and said gap;

said selected thermal coefficient of expansion of said metal of said TEM cavity, said selected thermal coefficient of expansion of said metal of said rod, said selected thermal coefficient of expansion of said dielectric material, said one selected physical dimension of said gap and said selected length of said rod are all selected relative to each other to equalize the rate of change of the equivalent inductive and capacitive reactance of said TEM cavity so that the difference between the rate of change of the equivalent inductive reactance of said TEM cavity and the rate of change of the equivalent capacitive reactance of said TEM cavity remains zero during a temperature variation at said predetermined operating frequency.

2. An arrangement according to claim 1, wherein said TEM cavity is a TEM coaxial re-entrant cavity, and said member of said TEM cavity is a wall of said TEM cavity adjacent said other end of said rod to provide said gap.

3. An arrangement according to claim 2, wherein said selected physical dimension is the width of said gap.

4. An arrangement according to claim 2, further including a threaded rod sleeve disposed adjacent said other end of said rod, and wherein said rod is threaded to engage said sleeve to enable movement of said rod in said sleeve to adjust the width of said gap.

5. An arrangement according to claim 4, wherein said width of said gap and the area of the end of said rod and said sleeve adjacent said gap are selected physical dimensions of said gap.

6. An arrangement according to claim 4, further including spring fingers to connect said one end of said rod to said one wall of said TEM re-entrant cavity.

7. An arrangement according to claim 1, wherein said TEM cavity is a TEM coaxial shunt cavity including a coaxial transmission line extending between an input and an output of said TEM shunt cavity, and a capacitive disc coupled to said coaxial transmission line, and said member of said TEM cavity is said capacitive disc.

8. An arrangement according to claim 7, wherein said selected physical dimension is the width of said gap.

9. An arrangement according to claim 7, further including a threaded sleeve disposed adjacent said other end of said rod, and wherein said rod is threaded to engage said sleeve to enable movement of said rod in said sleeve to adjust the width of said gap.

10. An arrangement according to claim 9, wherein said width of said gap and the area of the end of said rod and said sleeve adjacent said gap are selected physical dimensions of said gap.

11. An arrangement according to claim 9, further including spring fingers to connect said one end of said rod to said one wall of said TEM shunt cavity.

12. An arrangement according to claim 1, wherein said selected physical dimension is the width of said gap.

13. An arrangement according to claim 1, wherein the width of said gap and the area of said gap are selected physical dimensions of said gap.

* * * * *